US006705055B2

(12) United States Patent
Ritter et al.

(10) Patent No.: US 6,705,055 B2
(45) Date of Patent: Mar. 16, 2004

(54) BUILDING ELEMENT

(75) Inventors: Klaus Ritter, Graz (AT); Gerhard Ritter, Graz (AT)

(73) Assignee: EVG Entwicklungs-U. Verwertungs-Gesellschaft mbH, Raaba (AT)

( * ) Notice: Subject to any disclaimer, the term of this patent is extended or adjusted under 35 U.S.C. 154(b) by 0 days.

(21) Appl. No.: 09/809,855

(22) Filed: Mar. 16, 2001

(65) Prior Publication Data

US 2001/0010140 A1 Aug. 2, 2001

Related U.S. Application Data

(62) Division of application No. 08/556,924, filed as application No. PCT/AT93/00123 on Jul. 22, 1993, now Pat. No. 6,272,805.

(30) Foreign Application Priority Data

Jun. 2, 1993 (AT) ..... 1072/93

(51) Int. Cl.[7] ..... E04C 1/41

(52) U.S. Cl. ..... 52/309.11; 52/309.12; 52/405.3; 52/407.5; 52/410; 52/446; 52/454

(58) Field of Search ..... 52/309.1, 309.11, 52/309.12, 410, 223.7, 264, 293.3, 454, 407.5, 251, 405.3, 446

(56) References Cited

U.S. PATENT DOCUMENTS

| | | | | | |
|---|---|---|---|---|---|
| 3,305,991 | A | | 2/1967 | Weismann | |
| 3,879,908 | A | * | 4/1975 | Weismann | 52/309 |
| 4,079,560 | A | * | 3/1978 | Weismann | 52/309.7 |
| 4,104,842 | A | * | 8/1978 | Rockstead et al. | 52/650 |
| 4,226,067 | A | * | 10/1980 | Artzer | 52/309.12 |
| 4,297,820 | A | | 11/1981 | Artzer | |
| 4,454,702 | A | * | 6/1984 | Bonilla-Lugo et al. | 52/745 |
| 4,505,019 | A | * | 3/1985 | Deinzer | 29/432 |
| 4,541,164 | A | * | 9/1985 | Monzon Indave | 29/430 |
| 4,702,053 | A | | 10/1987 | Hibbard | |
| 5,129,203 | A | * | 7/1992 | Romero | 52/309.11 |
| 5,224,316 | A | * | 7/1993 | Fredericks et al. | 52/309.7 |
| 5,398,470 | A | * | 3/1995 | Ritter et al. | 52/309.11 |
| 5,487,248 | A | * | 1/1996 | Artzer | 52/309.12 |
| 5,596,853 | A | * | 1/1997 | Blaney et al. | 52/223.7 |
| 6,185,890 | B1 | * | 2/2001 | Ritter | 52/309.11 |
| 6,202,375 | B1 | * | 3/2001 | Kleinschmidt | 52/309.11 |
| 6,226,942 | B1 | * | 5/2001 | Bonin | 52/309.12 |
| 6,272,805 | B1 | * | 8/2001 | Ritter et al. | 52/309.11 |

FOREIGN PATENT DOCUMENTS

| | | |
|---|---|---|
| AT | 325 270 | 10/1975 |
| AT | 372 886 | 11/1983 |
| EP | 0 066 647 A1 | 12/1982 |
| FR | 2 161 875 | 7/1973 |
| FR | 2 324 815 | 4/1977 |
| FR | 2 355 969 | 1/1978 |
| GB | 2 234 276 A | 1/1991 |
| WO | WO 92/10624 | 6/1992 |

* cited by examiner

*Primary Examiner*—Carl D. Friedman
*Assistant Examiner*—Yvonne M. Horton
(74) *Attorney, Agent, or Firm*—Cohen, Pontani, Lieberman & Pavane

(57) ABSTRACT

Building element having two parallel welded wire grid mats (1, 2), of straight web wires (7) which hold the wire grid mats at a predetermined distance apart and are joined at each end to the two wire grid mats. An insulating body (8) is arranged between the wire grid mats, through which the web wires pass. At least one of the wire grid mats is in the form of a grid reinforcement mat which possesses a minimum strength of the weld nodes which complies with the static requirements applicable to the building element, corresponding mechanical strength of the grid mat wires (3, 4) and also corresponding diameters and mutual spacings of the grid mat wires. The web wires are arranged in predetermined directions relative to the wire grid mats, and the insulating body is held at a predetermined distance from each of the wire grid mats.

2 Claims, 9 Drawing Sheets

BUILDING ELEMENT

RELATED APPLICATIONS

This is a U.S. National Phase Application under 35 USC 371 of International Application PCT/AT93/00123, filed on Jul. 22, 1993.

This application is a division of application Ser. No. 08/556,924, filed Nov. 29, 1995, now U.S. Pat. No. 6,272,805, which is a 371 of PCT/AT93/00123, filed Jul. 22, 1993.

The invention relates to a building element consisting of two parallel wire grid mats, of straight web wires which hold the wire grid mats at a predetermined distance apart and are joined at each end to the two wire grid mats, and of an insulating body which is arranged between the wire grid mats and through which the web wires pass.

From AT-PS 372 886 a method and an apparatus for producing a building element of this kind are known. For this purpose two lengths of wire grid are first brought into a parallel position at a distance apart corresponding to the desired thickness of the grid body which is to be produced. An insulating body is inserted into the gap between the lengths of wire grid, at a distance from each of the lengths of wire grid. Web wires are passed through one of the two lengths of wire grid into the gap between the latter and the insulating body, in such a manner that each web wire comes to lie close to a grid wire of each of the two lengths of wire grid, whereupon the web wires are welded to the grid wires of the lengths of wire grid. Finally, building elements of appropriate length are separated off from the grid body produced in this manner.

From U.S. Pat. No. 3,305,991 a building element is known which consists of a three-dimensional grid body in which a one-piece insulating body is formed in situ by foaming. The grid body comprises two wire grid mats which are arranged at a distance from one another and which are joined by means of zigzag web wires. On the building site the building element is provided with a coating of concrete or mortar on each of its two cover surfaces. It is here a disadvantage that because of the complicated production process a modification of the shape and dimensions of the building element, particularly for the purpose of adaptation to different static requirements, is possible only with difficulty, and that only materials which can be foamed in situ can be used as material for the insulating body. It is also a disadvantage that the web wires can be connected at their wave crests to the grid wires only at one point in each case.

From U.S. Pat. No. 4,104,842 a building element is known whose three-dimensional grid body likewise comprises two wire grid mats arranged at a distance from one another, together with web wires of a zigzag configuration which join together the wire grid mats. On the inner side of at least one wire grid mat, spaced apart from the latter, a cover layer of building paper is applied to serve as limiting layer for the concrete shell subsequently to be applied. If two cover layers are used, a cavity which can subsequently be filled with material is formed in the interior of the building element. Here again a disadvantage is the complicated production process, which makes it difficult to modify the shape and dimensions of the building element, and also the fact that the materials for the insulating body are restricted to substances which must be pourable or flowable in order to be able to fill the cavity which is formed in the building element and through which the zigzag web wires pass. It is in addition a disadvantage that the web wires are connected at their wave crests to the grid wires only at one point in each case.

The problem underlying the invention is that of providing a building element of the type indicated in the preamble above, which can be produced in a simple manner and can quickly be adapted to various static requirements. The building element should at the same time permit the selection of different materials for the insulating body and facilitate the application of the concrete layer at the site where the building element is to be used. The building element according to the invention is distinguished in that at least one of the wire grid mats is in the form of a grid reinforcement mat which possesses a minimum strength of the weld nodes which complies with the static requirements applicable to the building element, corresponding mechanical strength of the grid mat wires and also corresponding diameters and mutual spacings of the grid mat wires, in that the web wires are arranged in predetermined directions relative to the wire grid mats, and in that the insulating body is held at a predetermined distance from each of the wire grid mats.

In comparison with the known building elements having zigzag web wires and only one weld point in the region of the wave crest, the building element according to the invention has the advantage that the web wires are in the form of individual wires and therefore two weld points exist in the region of the connection to the grid mat wires, so that static safety is practically doubled.

In the building element according to the invention the web wires are preferably arranged in trelliswork fashion between the wires of the wire grid mats and are inclined alternately in opposite directions. As an alternative, the web wires can be arranged, between the wires of the wire grid mats, in rows in which the web wires are inclined in the same direction, the directional sense changing from row to row. According to another variant of the invention the web wires may extend at right angles to the wire grid mats, and the insulating body may be additionally fastenable in position relative to the wire grid mats by means of a plurality of spacers supported on the wires of the wire grid mats.

In a preferred embodiment of the invention the grid body formed from the wire grid mats and the web wires is reinforced, at least at two opposite edges, by edge web wires which preferably extend at right angles to the wire grid mats and are welded to the edge wires of the grid mats. At the edge of the wire grid mats the grid mat wires preferably end in this case flush with the respective edge wires of the grid mats.

Within the scope of the invention the insulating body preferably consists of a dimensionally stable material, which expediently is an acoustic and thermal insulator.

According to the invention, however, two separating layers, which are arranged at a predetermined distance from the wire grid mats, are fastened by the web wires and/or the spacers and enclose a gap of predetermined width, may also be provided, while in order to form a central insulating layer the gap may preferably be filled with heapable, pourable or flowable materials which preferably are acoustic and thermal insulators.

For the practical use of the building element as a wall or ceiling element it is particularly advantageous for at least one wire grid mat to project laterally beyond the insulating body or the central insulating layer at at least one side surface of the insulating body or of the central insulating layer. In this case there may be applied to the outer wire grid mat which is intended to form the outer side of the building element an outer shell of concrete, which adjoins the insulating body or the separating layer adjoining the outer wire grid mat and surrounds the outer wire grid mat and which, together with the latter, forms the bearing component of the building element.

According to another feature of the invention there is applied to the inner wire grid mat which is intended to form the inner side of the building element an inner shell, which adjoins the insulating body or the separating layer adjoining the inner wire grid mat and surrounds the inner wire grid mat and which, together with the latter, forms the bearing component of the building element.

Further features and advantages of the invention will be explained more fully with the aid of some exemplary embodiments and with reference to the drawings, in which.

Figure 17:
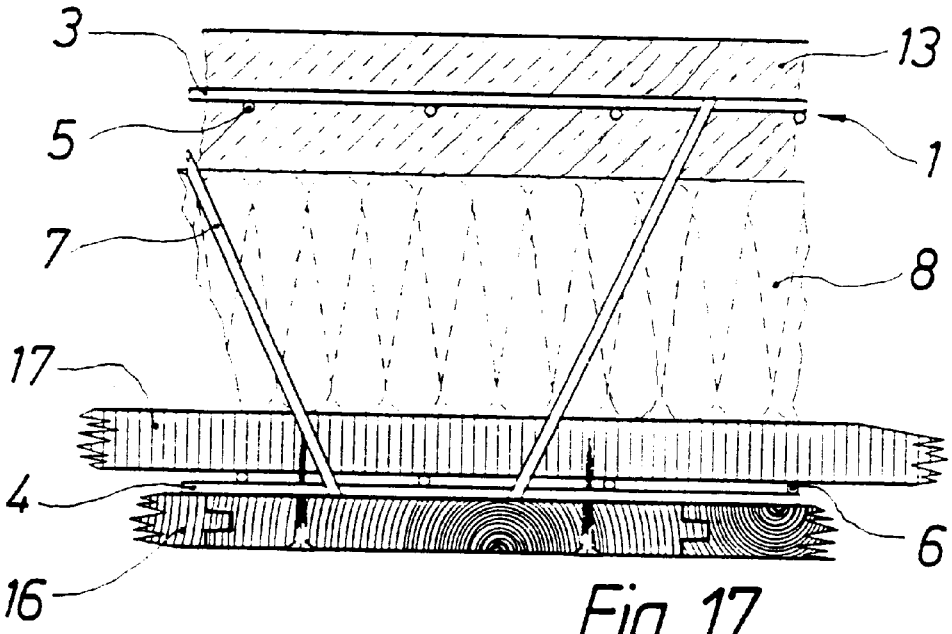
Figure 16A:
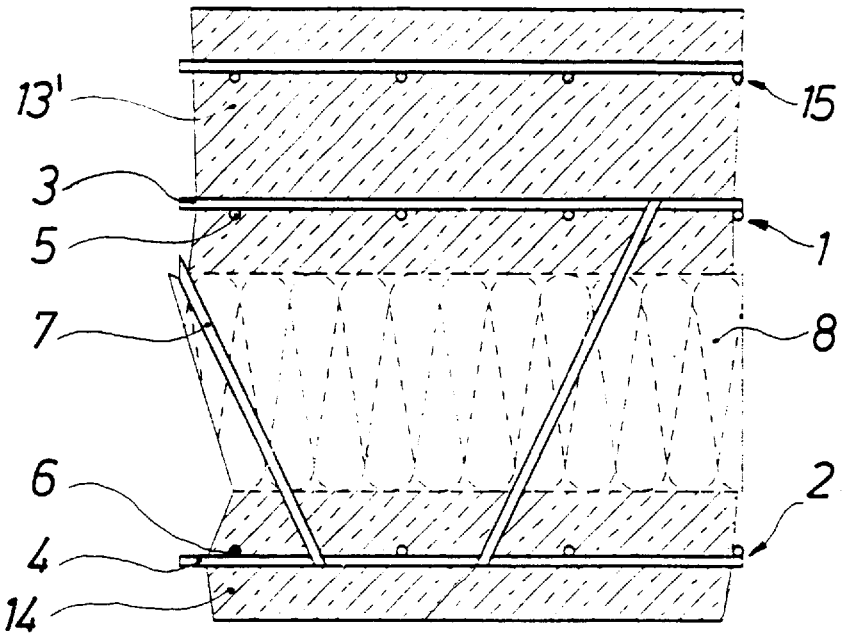
Figure 16B:
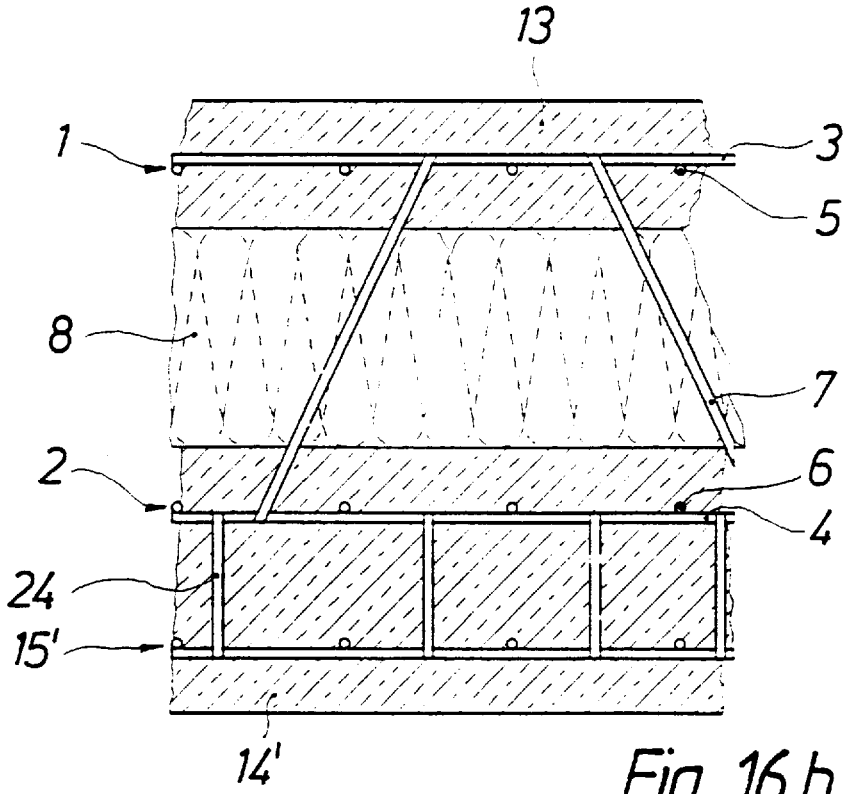
Figure 18:
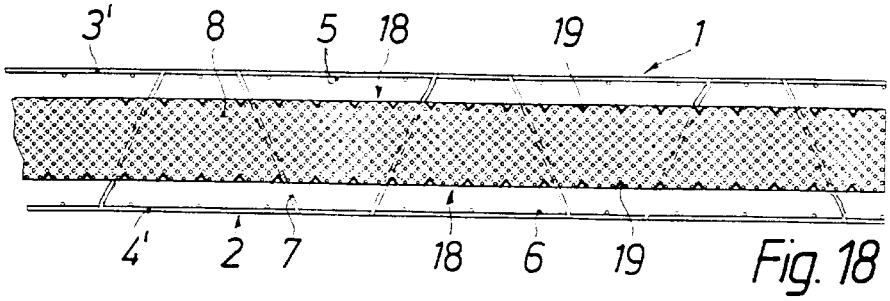
Figure 19:
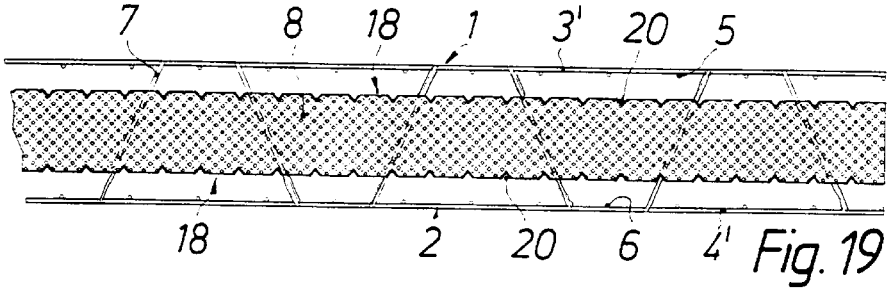
Figure 20:
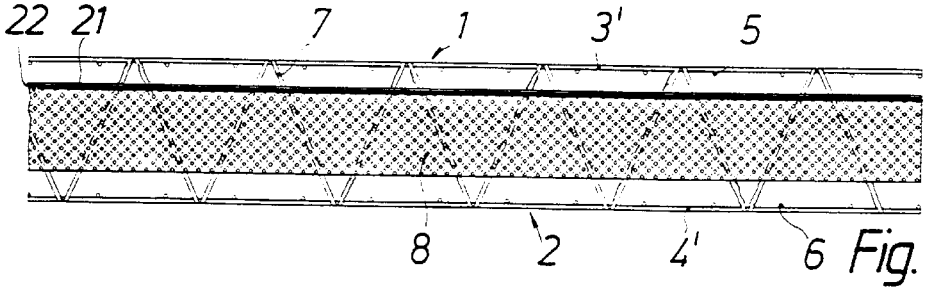
Figure 21:
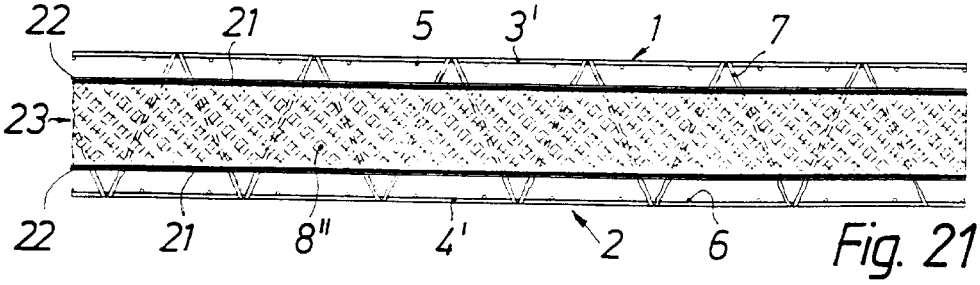

FIG. 16*a* is a section through a building element with a reinforcement in two layers, an additional reinforcement mat being provided in the outer shell and the inner shell consisting of concrete;

FIG. 16*b* is a section through a building element with a reinforcement in two layers, an additional reinforcement mat being provided in the inner shell and the outer shell consisting of concrete;

FIG. 17 is a section through a building element with an outer shell of concrete and with a lining board on the inner side of the building element;

FIG. 18 is a side view of a building element with an insulating body whose cover surfaces are provided with depressions;

FIG. 19 is a side view of a building element with an insulating body whose cover surfaces are provided with cross grooves;

FIG. 20 is a side view of a building element with a plaster base grid and with a separating layer on a cover surface of the insulating body, and FIG. 21 is a side view of a building element with two separating layers and two plaster base grids in each case and with a layer of insulating material lying therebetween.

Figure 1:
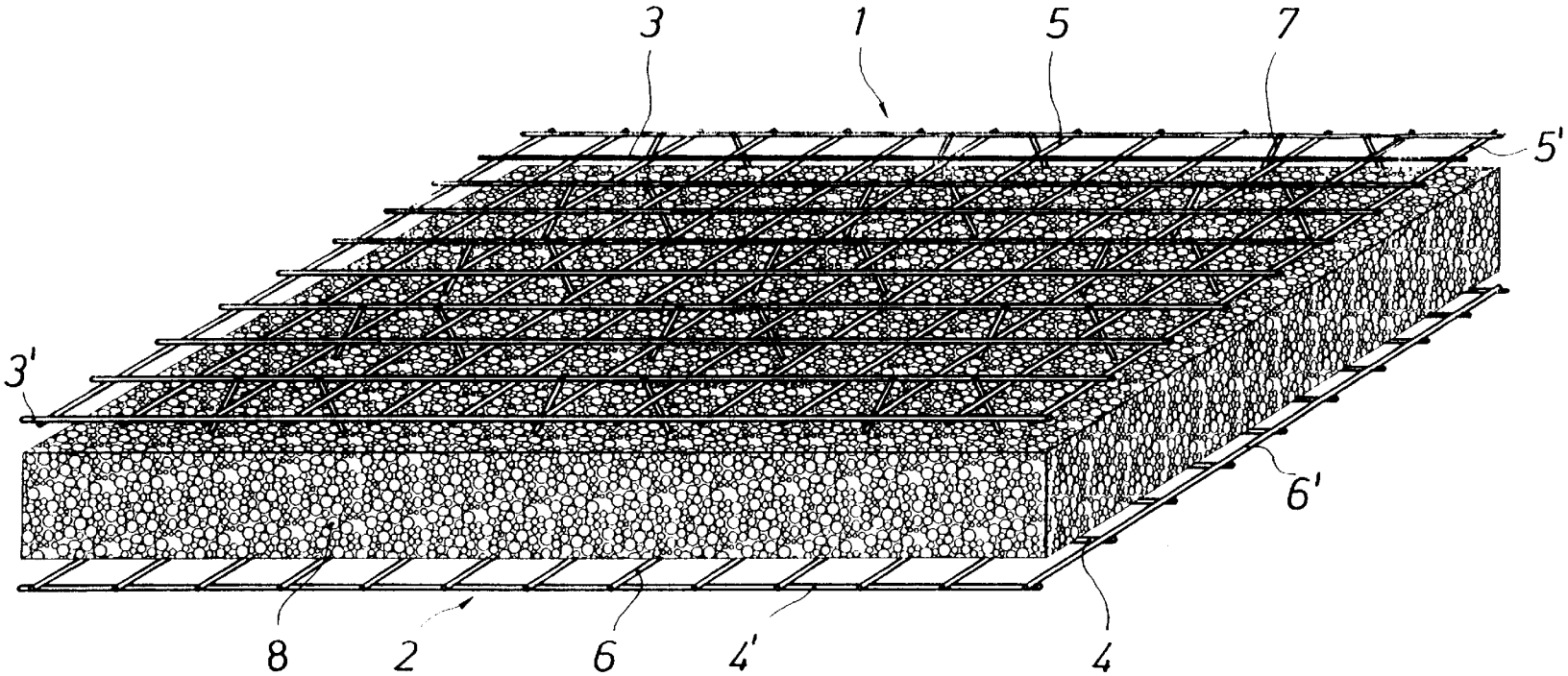
FIG. 1 is an axonometric view of a building element according to the invention.

The building element shown in FIG. 1 consists of two flat wire grid mats 1 and 2, which are arranged parallel to one another and at a predetermined distance from one another. Each wire grid mat 1 and 2 consists of a plurality of longitudinal wires 3 and 4 respectively and of a plurality of cross wires 5 and 6 respectively, which cross one another and are welded together at the crossing points. The distance between the respective longitudinal wires 3 and 4 and the respective cross wires 5 and 6 is selected in accordance with the static regulations applicable to the building element. The distances are preferably selected to be the same, for example in the range from 50 to 100 mm, so that the longitudinal and cross wires lying next to one another in each case form square meshes. Within the scope of the invention the meshes of the wire grid mats 1, 2 may also be rectangular and, for example, have short side lengths of 50 mm and long side lengths in the range from 75 to 100 mm.

The diameters of the longitudinal and cross wires are likewise selected in accordance with the static requirements and are preferably in the range of 2 to 6 mm. Within the scope of the invention the surface of the grid mat wires may be smooth or ribbed.

The two wire grid mats 1, 2 are joined together by a plurality of web wires to form a dimensionally stable spatial grid body. At their ends the web wires 7 are each welded to the wires of the two wire grid mats 1, 2, while within the scope of the invention the web wires 7 may either be welded to the respective longitudinal wires 3, 4, as shown in the drawing, or be welded to the cross wires 5, 6. The web wires 7 are arranged to slope alternately in opposite directions, that is to say in lattice fashion, so that the grid body is stiffened against shear stresses.

The distances between the web wires 7 and the distribution of the latter in the building element depend on static requirements applicable to the building element and for example amount to 200 mm along the longitudinal wires and to 100 mm along the cross wires. The distances of the web wires 7, 7' from one another in the direction of the longitudinal wires 3, 4 of the grid mat and of the cross wires 5, 6 of the grid mat expediently amount to a multiple of the mesh pitch. The diameter of the web wires is preferably in the range of 3 to 7 mm, while in the case of building elements which have thin longitudinal and cross wires the diameter of the web wires is preferably selected to be larger than the diameter of the longitudinal and cross wires.

Since the spatial grid body formed from the two wire grid mats 1, 2 and the web wires 7 must not only be dimensionally stable but, in the case of its preferred use as a wall and/or ceiling element, must serve as a spatial reinforcement element, that is to say has to take shearing and compressive forces, the longitudinal and cross wires are welded to one another, as is customary for reinforcement mats, and the web wires 7 are also welded to the grid mat wires 3, 4, 5, 6, while maintaining a minimum strength of the weld nodes. In order to be able to serve as a spatial reinforcement element, the grid mat wires 3, 4, 5, 6 and the web wires 7 must be made of suitable materials and have appropriate mechanical strength values to be able to be used as reinforcement wires for the wire grid mats 1, 2 which are to serve as reinforcement mats, and, respectively, to be used as reinforcement wires connecting the two wire grid mats 1, 2.

Within the scope of the invention it is also possible to connect the web wires 7, 7' at both their ends by means of plastics cord knots or lashing, for example. As an alternative the web wires 7, 7' may be joined at one end in this manner and at their other end by means of welding to the grid mat wires 3, 4, 5, 6.

In the gap between the wire grid mats 1, 2 an insulating body 8 is arranged at a predetermined distance from the wire grid mats and centrally relative to the latter, and serves for thermal insulation and sound deadening. The insulating body 8 consists for example of foam plastics, such as polystyrene or polyurethane foam, foam materials based on rubber and caoutchouc, lightweight concrete, such as autoclave or aerated concrete, porous plastics, porous substances based on rubber and caoutchouc, pressed slag, pressed sludge, gypsum plasterboard, cement-bound compressed boards consisting of wood chips, jute, hemp and sisal fibres, rice husks, straw waste, sugarcane waste, or mineral and glass wool, corrugated cardboard, compressed waste paper, bound stone chips, melted reusable plastics waste, tied reed and bamboo canes.

The insulating body 8 may be provided with predrilled holes to receive the web wires 7. The insulating body 8 may also be provided on one or both sides with a layer of plastics material or aluminium serving as vapour barrier. The position of the insulating body 8 in the building element is determined by the obliquely extending web wires 7 which pass through the insulating body 8.

The thickness of the insulating body 8 is freely selectable and lies for example in the range from 20 to 200 mm. The distances from the insulating body 8 to the wire grid mats 1, 2 are likewise freely selectable and lie for example in the range from 10 to 30 mm. The building element can be made in any desired length and width, while because of the method of production a minimum length of 100 cm and standard widths of 60 cm, 100 cm, 110 cm and 120 cm have proved advantageous.

Figure 2:
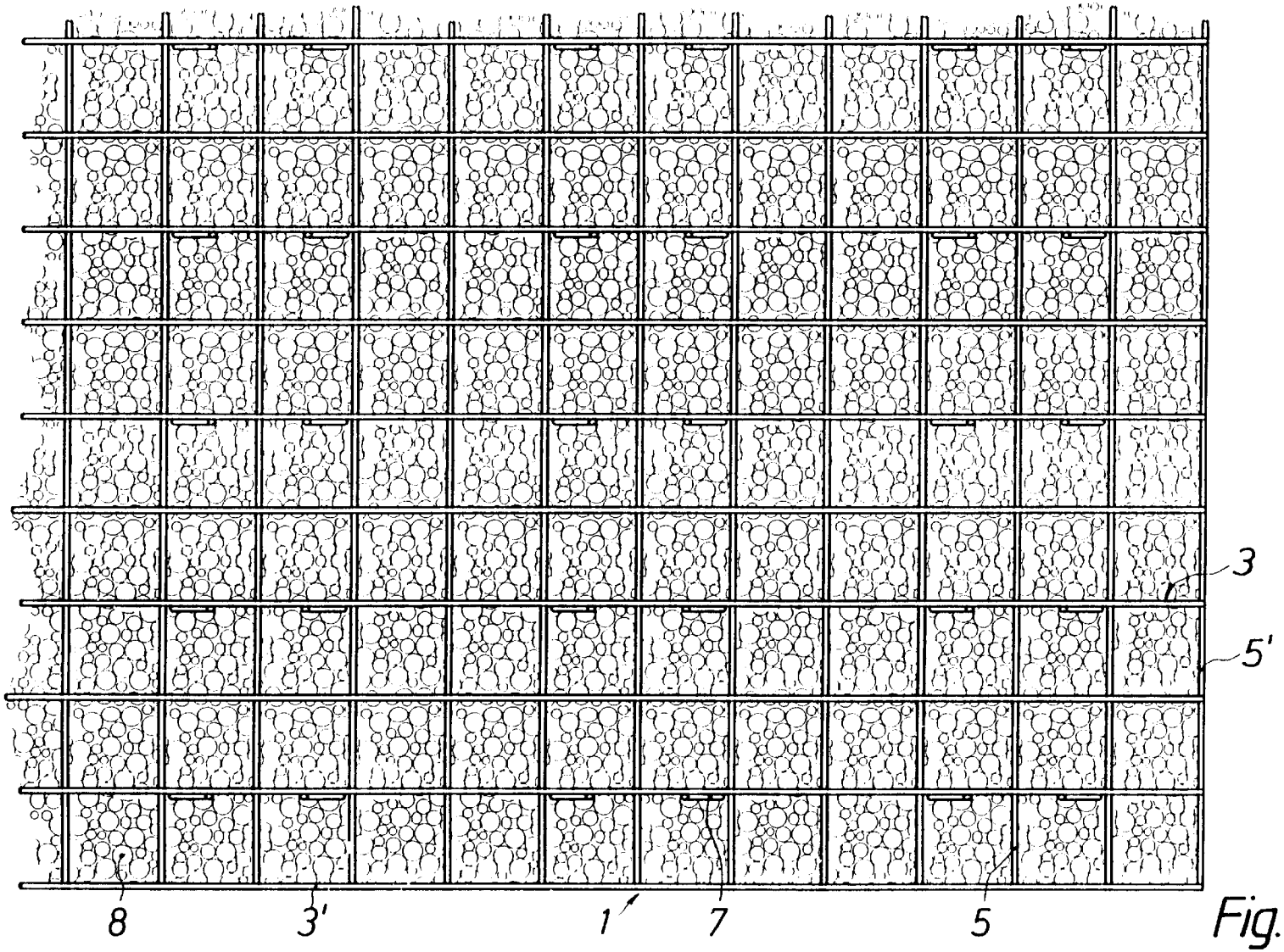
FIG. 2 is a plan view of the building element shown in FIG. 1.

As can be seen from the plan view of the building element shown in FIG. 2, at the edge of the building element the longitudinal wires 3 and the edge longitudinal wires 3' end in each case flush with the edge cross wires 5', and the cross wires 5 and the edge cross wires 5' end in each case flush with the edge longitudinal wires 3'. The same applies analogously to the grid mat wires 4, 4', 6, 6' of the other wire grid mat 2.

Figure 3:
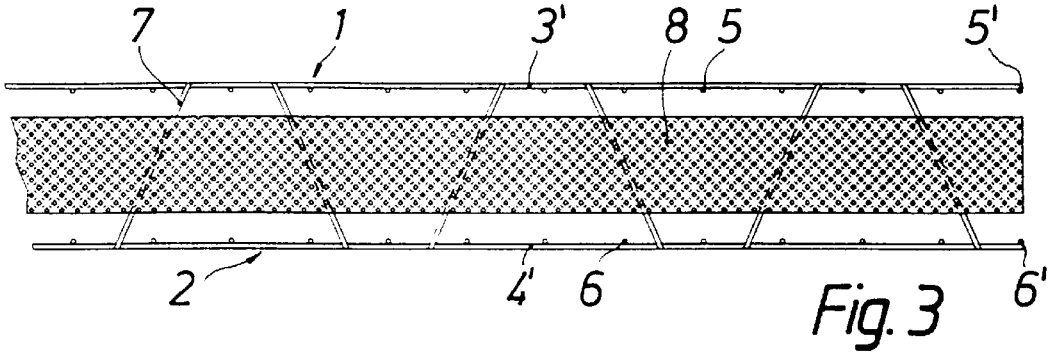
FIG. 3 is a side view of the building element shown in FIG. 1, viewed in the direction of the cross wires.

FIG. 3 shows a side view of the building element shown in FIG. 1, viewed in the direction of the set of cross wires. The web wires 7, which extend obliquely alternately in opposite directions to one another, here form a row and are in each case welded to the corresponding longitudinal wires 3 and 4, arranged one above the other, of the wire grid mats 1 and 2 respectively.

Figure 4:
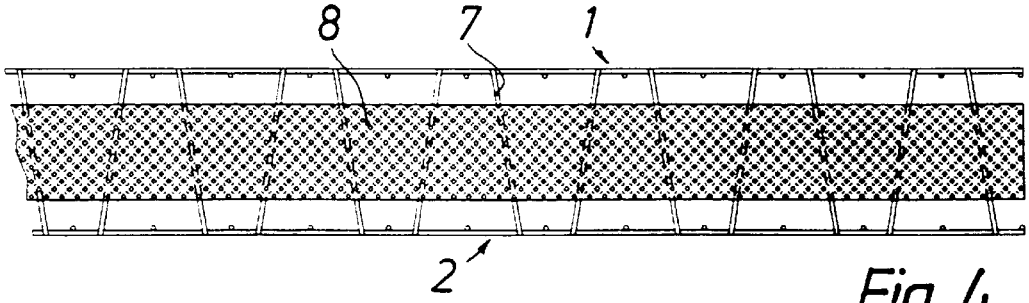
FIGS. 4 to 8 are side views of building elements according to the invention with various exemplary embodiments for the arrangement of the web wires within the building element.
Figure 5:
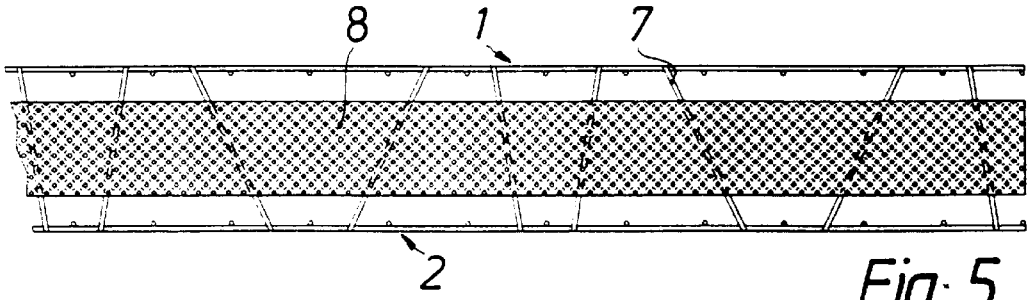

FIGS. 4 and 5 each show an exemplary embodiment with different angles between the web wires 7 and the corresponding longitudinal wires 3, 4 of the wire grid mats 1, 2, while in accordance with FIG. 5 different angles are also possible within a row of web wires within a building element.

Figure 6:
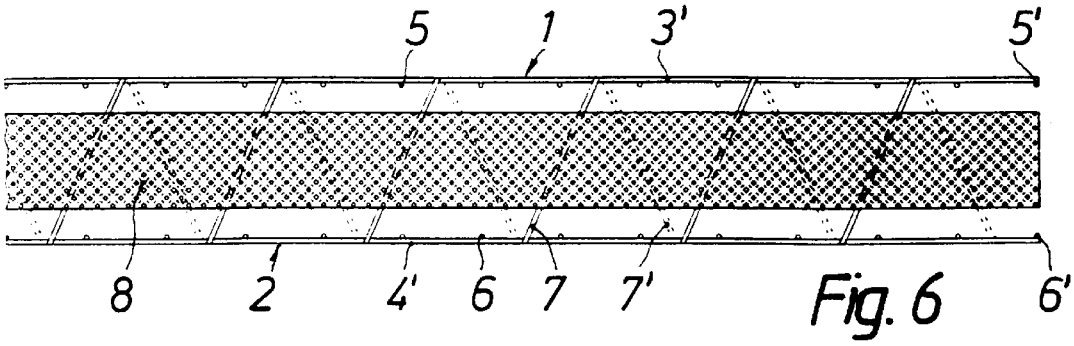

FIG. 6 shows a building element in which the web wires 7 in one row extend codirectionally obliquely between the longitudinal wires 3 and 4 of the wire grid mats 1, 2, while in the next row the web wires 7' shown in dashed lines likewise extend codirectionally obliquely, but in the opposite directional sense, between the corresponding longitudinal wires, that is to say the building element has a plurality of rows of codirectionally oblique web wires with the directional sense changing from row to row. Within the scope of the invention the rows of web wires directed codirectionally obliquely may also extend between the cross wires 5, 6 of the wire grid mats 1, 2.

Figure 7:
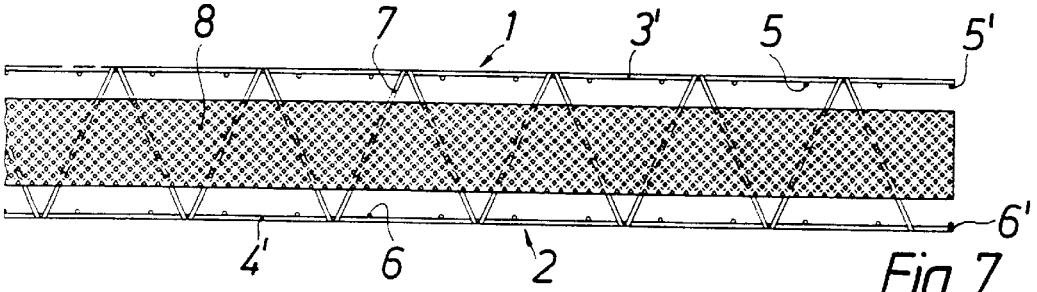

FIG. 7 shows a building element having web wires 7 extending obliquely in opposite directions for each row, the distances between neighbouring web wires in the row being so selected that the mutually facing ends of the web wires come as close as possible to one another, so that two web wires may optionally be welded conjointly in one operation to the corresponding grid wire.

Figure 8:
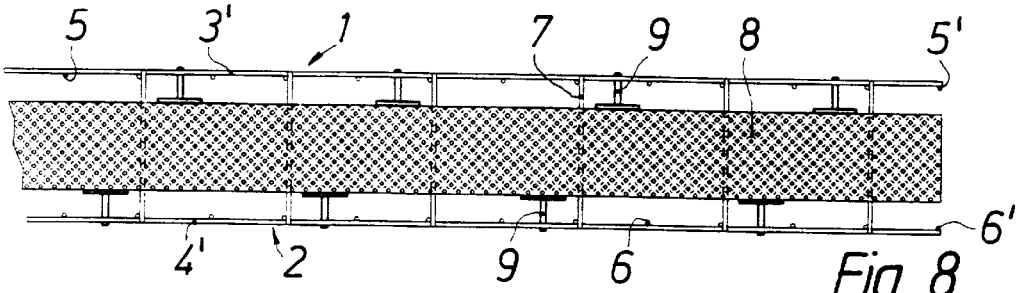

Within the scope of the invention the web wires 7, as shown in FIG. 8, may also be arranged at right angles to the wire grid mats 1, 2. Since in this case the position of the insulating body 8 in the grid body is only inadequately fixed by the web wires 7, for the purpose of fastening the insulating body 8 a plurality of spacers 9 are provided, each of which is supported on the corresponding grid mat wires of the wire grid mats 1, 2. The spacers 9 are also used in building elements having obliquely extending web wires 7 if, because of the nature of the material of the insulating body, the fastening of the latter in the grid body is not ensured by the web wires. This applies for example to insulating bodies consisting of tied reed or bamboo canes.

Figure 9:
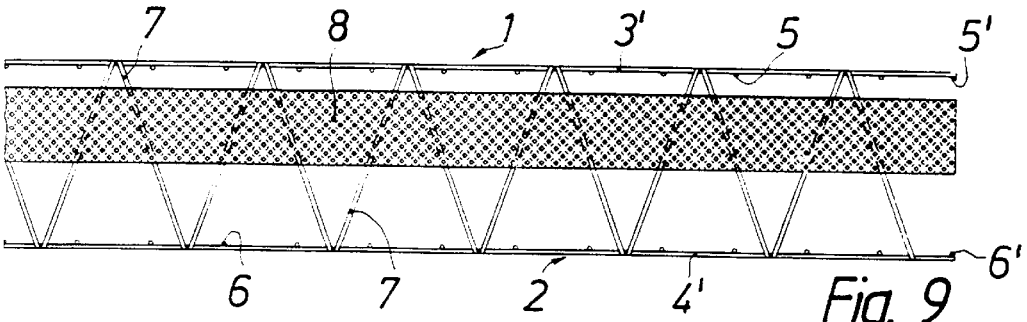
FIG. 9 is a side view of a building element with an asymmetrically arranged insulating body.

As FIG. 9 shows, the insulating body 8 may also be arranged asymmetrically to the two wire grid mats 1, 2. In this case the diameters of the grid wires 4, 4', 6, 6' of the wire grid mat 2 lying at the greater distance from the insulating body 8 are advantageously larger than the diameters of the grid wires 3, 3', 5, 5' of the wire grid mat 1 lying closer to the insulating body 8.

Figure 10:
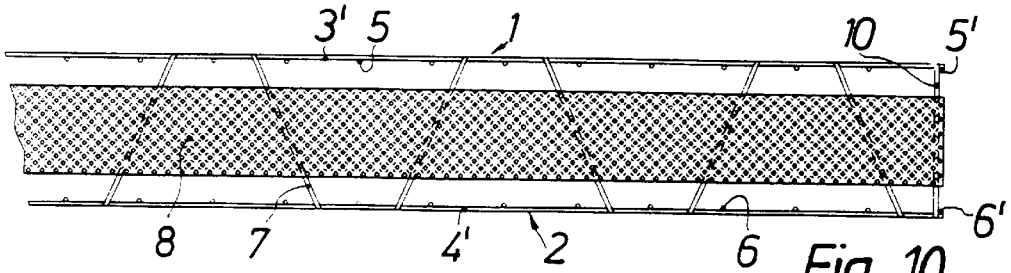
FIG. 10 is a side view of a building element with additional edge web wires extending at right angles to the wire grid mats.

In order to stiffen the grid body at its edges, according to FIG. 10 additional edge web wires 10 may be provided, which preferably extend at right angles to the wire grid mats 1, 2 and are welded to the corresponding edge grid wires 3', 4', 5', 6' of the wire grid mats 1, 2. The diameter of the edge web wires 10 is preferably equal to the diameter of the web wires 7, 7'.

Figure 11:
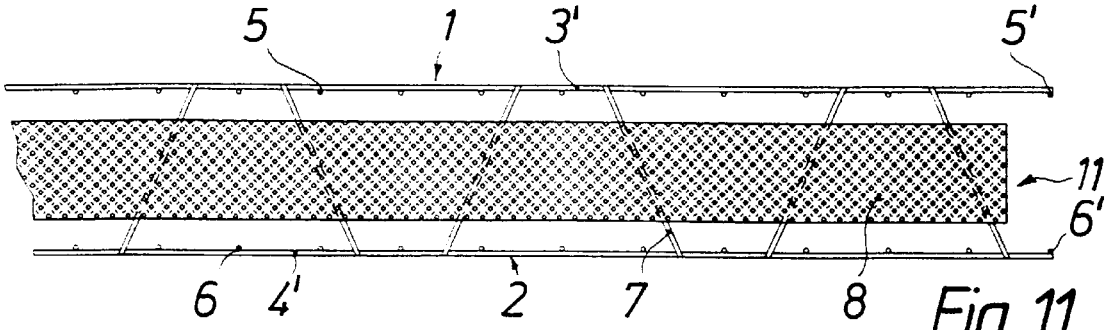
FIG. 11 is a side view of a building element with wire grid mats projecting laterally beyond the insulating body at the edge of the building element.

In FIG. 11 a building element according to the invention is shown, in which at the side surfaces 11 extending parallel to the cross wires 5, 6 the insulating body 8 does not end flush with the two wire grid mats 1,2, but the latter project laterally beyond it. By means of this embodiment, when two identical building elements are joined together, the effect is achieved that the insulating bodies of adjoining building elements can be arranged without a gap, while the wire grid mats of the two building elements overlap in each case and thus form a bearing overlap joint.

The insulating body 8 may also end flush with the inner wire grid mat 2 at its two side surfaces 11, and only the wire grid mat 1 which will be on the outside in practical use may project beyond it.

One or both of the wire grid mats may also project laterally beyond the insulating body 8 on all the side surfaces. In these exemplary embodiments any edge web wires 10 provided may be so arranged that they extend outside the insulating body or laterally adjoin the latter.

Figure 12:
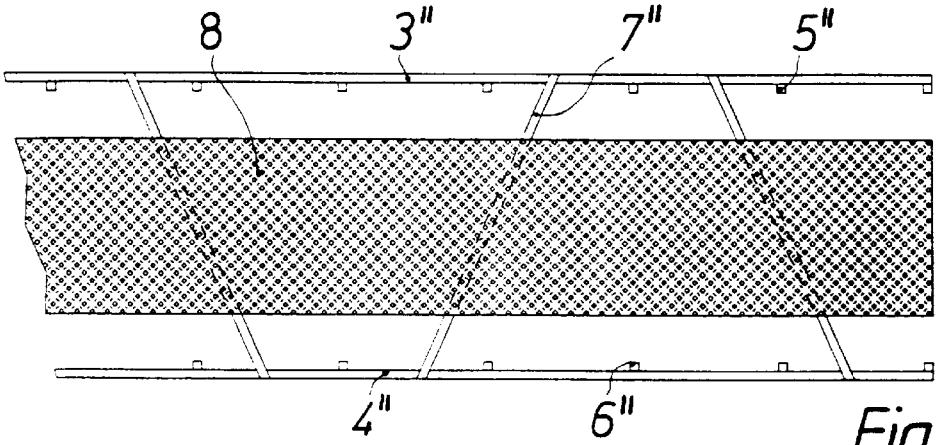
FIG. 12 is a side view of a building element with square wires of the wire grid mats and square web wires.

The longitudinal and cross wires of the wire grid mats 1, 2 and also the web wires may have any desired cross-section. The cross-sections may be oval, rectangular, polygonal or, as illustrated in FIG. 12, square. The reference numerals of the corresponding wires are 3" and 4" respectively for the square longitudinal wires, 5" and 6" respectively for the square cross wires, and 7" for the square web wires.

Figure 13:
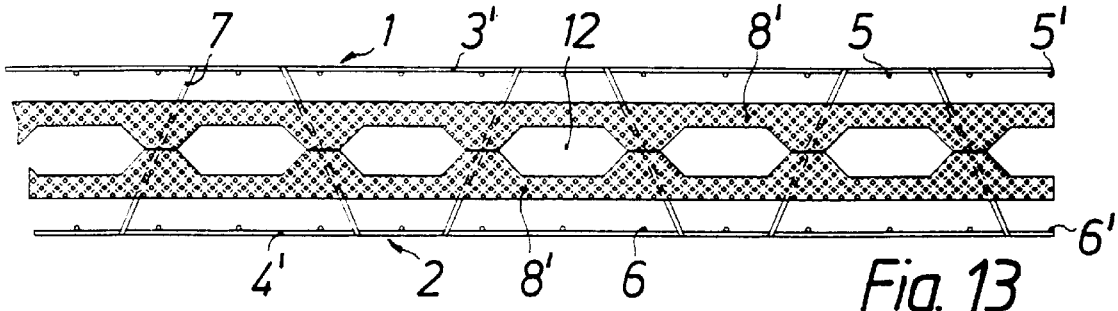
FIG. 13 is a side view of a building element with an insulating body provided with cavities.

FIG. 13 shows a building element which has a two-part insulating body 8'. In this case the parts of the insulating body may if necessary be bonded together at their contact surfaces. The two parts of the insulating body 8' enclose cavities 12 in order to save material, but these may also be filled with other materials, for example heapable, pourable and flowable insulating materials, such as wood chips, foam plastic chips, sand, plastic waste, rice waste, or straw waste. The insulating body 8' may also consist of a plurality of parts which can be joined together and for example have a multilayer construction. It is in addition possible to provide a one-piece insulating body 8 with cavities 12.

Figure 14:
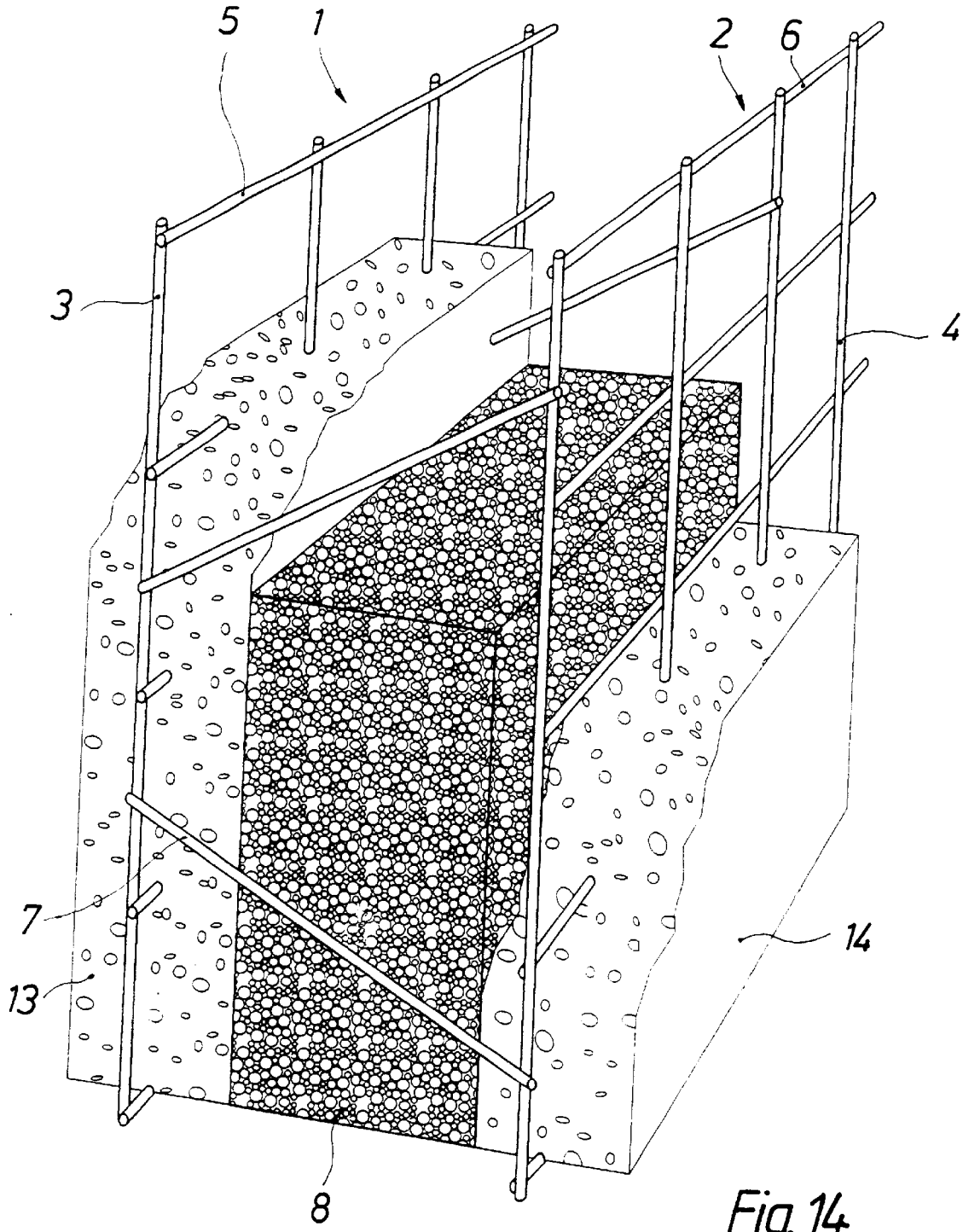
FIG. 14 is a schematic view in perspective of a building element with an outer shell and an inner shell of concrete.
Figure 15:
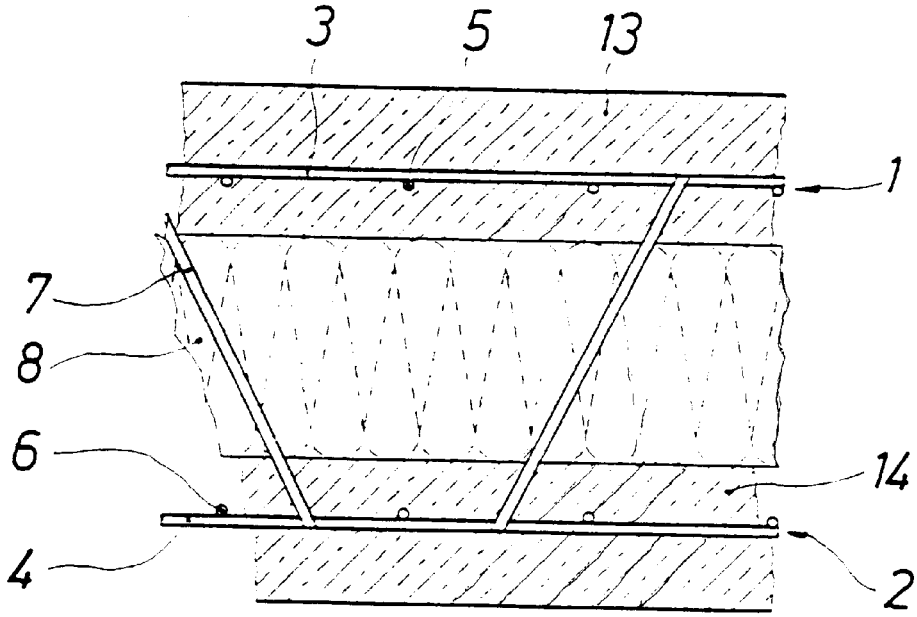
FIG. 15 shows part of a section through a building element according to FIG. 14.

As schematically illustrated in FIGS. 14 and 15, there is applied to the outer wire grid mat 1 intended to form the outer side of the building element an outer shell 13, for example of concrete, which adjoins the insulating body 8, surrounds the outer wire grid mat 1 and together with the latter forms the bearing component of the building element according to the invention. The thickness of the outer shell 13 is selected in accordance with the static, acoustic and thermal requirements applicable to the building element, and amounts for example to from 20 to 200 mm. If the building element is used as a ceiling element, the minimum thickness of the outer shell 13 must for static reasons amount to 50 mm.

To the inner wire grid mat 2 intended to form the inner side of the building element an inner shell 14 is applied, which adjoins the insulating body 8, surrounds the inner wire grid mat 2 and for example consists of concrete or mortar. The thickness of the inner shell 14 is selected in accordance with the static, acoustic and thermal requirements applicable to the building element and amounts for example to from 20 to 200 mm. The two shells 13, 14 are preferably applied at the site where the building element is used, for example sprayed on by the wet or dry method.

Since the portions of the web wires 7, 7' which lie in the inner region of the building element, and also the edge web wires 10 when these are provided, are not covered with concrete and are therefore exposed to corrosion, the wires 7, 7' and 10 must be provided with an anticorrosive layer. This is preferably achieved by means of galvanising and/or coating of the wires 7, 7' and 10. For reasons of cost it has proved advantageous for galvanised wire already to be used, at least for the web wires 7, 7', in the production of the grid body. The wires 7, 7' and 10 may also be made of stainless steel grades or other non-corroding materials, for example aluminium alloys, which must be capable of being joined, preferably by welding, to the grid wires of the wire grid mats 1, 2. Within the scope of the invention, not only the web wires 7, 7' and 10 but also the grid mat wires of the wire grid mats 1, 2 may be provided with an anti-corrosion layer or be made of stainless steel grades or of other non-corroding materials.

For static reasons and/or in order to improve sound deadening it may be necessary to provide the building element, at least on one side, with a very thick concrete shell having reinforcement in two layers. In FIG. 16*a* a part of a building element is shown which has a very thick outer shell 13' of concrete, this outer shell 13' being reinforced with an additional, outer reinforcement mat 15 the distance between which and the outer wire grid mat 1 is freely selectable in accordance with the static requirements applicable to the building element. The additional outer reinforcement mat 15 prevents cracking in the outer shell 13' caused by temperature and shrinkage stresses.

For static reasons and/or in order to improve sound deadening, the building element may also be provided with a very thick inner shell 14', which is reinforced either by an inner wire grid mat 2 or, as shown in FIG. 16*b*, with an inner wire grid mat 2 and an additional, inner reinforcement mat 15'. The distance between the additional inner reinforcement mat 15' and the inner wire grid mat 2 is freely selectable in accordance with the static requirements applicable to the building element. The diameters of the grid wires of the additional inner reinforcement mat 15' are preferably larger than the diameters of the grid wires of the two wire grid mats 1, 2 and lie, for example, in the range from 6 to 6 mm. If the thick inner shell 14' is reinforced only with the inner wire grid mat 2, the diameters of the grid wires 4, 4', 6, 6' of the inner wire grid mat 2 and of the web wires 7, 7' are preferably larger than the diameters of the grid wires 3, 3', 5, 5' of the outer wire grid mat 1 and lie, for example, in the range from 5 to 6 mm.

The inner wire grid mat 2 and the additional inner reinforcement mat 15' may be joined by a plurality of spacer wires 24, which preferably extend at right angles to the inner wire grid mat 2 and the additional inner reinforcement mat 15' and the mutual lateral spacing of which is freely selectable. The diameter of the spacer wires 24 is preferably equal to the diameters of the grid wires of the wire grid mats 1, 2.

Within the scope of the invention the additional outer reinforcement mat 15 and the outer wire grid mat 1 may also be joined by spacer wires, which preferably extend at right angles to the outer wire grid mat 1 and to the additional outer reinforcement mat 15. These spacer wires are arranged at selectable lateral distances from one another and have diameters which are preferably equal to the diameters of the grid wires of the two wire grid mats 1, 2.

The thick concrete shells 13' and 14' provided with reinforcement in two layers can also be poured with site concrete at the place where the building element is used, in which case the outer boundary of the concrete shells 13', 14' is formed by shuttering (not shown).

As FIG. 17 shows, there may be arranged on the inner side of the building element, instead of the inner concrete shell, a lining board 16 which lies on the inner wire grid mat 2 and is fastened to a mounting aid device 17. The lining board 16 forms the non-bearing inner wall of the building element and, as it has no static duties to perform, can be made of light building material, such as a plywood board, gypsum plasterboard and the like, and have a decorative configuration complying with the desired finish of the interior space. The mounting aid device 17 is arranged between the insulating body 8 and the inner wire grid mat 2 and consists for example of a plurality of strips, which extend in the vertical direction between the web wires when the building element is used as a wall building element. The mounting aid device 17 may, if necessary, be fastened to the wires 4 and 6 of the inner wire grid mat 2, for example by means of staples (not shown), or to the insulating body 8, for example by means of an adhesive coating. The mounting aid device 17 must consist of suitable material, for example wood, which ensures secure anchoring of the lining board 16 to the inner wire grid mat 2 lying therebetween. By means of the configuration according to the invention the lining board 16 is not fastened to the insulating body 8, which obviously because of the nature of its material does not permit secure attachment, but is firmly anchored to or clamped fast against the inner wire grid mat 2.

In order to improve the adhesion to the two cover surfaces 18 of the insulating body 8, 8' which face the wire grid mats 1, 2 when the outer shell 13 and the inner shell 14 of concrete are sprayed on, and to prevent the material from flowing down undesirably during working, the cover surfaces 18 of the insulating body 8, 8' may be roughened. As shown in FIG. 18, the cover surfaces may be provided with depressions 19, which are formed in the cover surfaces 18 of the insulating body, for example with the aid of toothed wheels or rollers carrying spikes or knobs on their periphery, during the production of the building element.

Within the scope of the invention it is possible, in accordance with FIG. 19, to provide the insulating body 8, 8' on its cover surfaces 18 with cross grooves 20, which extend in the horizontal direction when the building element is used as a wall element. The depressions 19 and the cross grooves 20 may also, within the scope of the invention, already be produced during the production of the insulating body.

With a view to improving the adhesion of the outer concrete shell 13 to the insulating body 8, 8', as illustrated in FIG. 20 use may be made of a plaster base grid 21, which lies on the cover surface 18 of the insulating body 8, 8' and is fixed by the web wires 7 or the insulating body 8, 8'. The plaster base grid 21 consists for example of a fine-mesh welded or woven wire grid with a mesh width of for example 10 to 25 mm and wire diameters in the range from 0.8 to 1 mm. The plaster base grid 21 may within the scope of the invention also consist of expanded metal. Between the plaster base grid 21 and the cover surface 18 of the insulating body 8, 8' an additional separating layer 22 may be arranged, which consists for example of impregnated building paper or cardboard and which at the same time serves as a vapour barrier and is preferably joined to the plaster base grid 21.

In FIG. 21 another exemplary embodiment of a building element according to the invention is shown, wherein two separating layers 22 are arranged in the building element with selectable spacing from the respective neighbouring wire grid mat 1 or 2, and are spaced at a selectable distance from one another such that a gap 23 is formed between the separating layers 22. The separating layers 22 may for example consist of cardboard, paperboard, plastics sheets, thin gypsum plasterboard or concrete slabs with or without reinforcement. The separating layers 22 are fastened in position relative to the wire grid mats 1, 2 either by the web wires 7 or with the aid of spacers. The gap 23 between the separating layers 22 is filled, either during the production of the building element or only at the site where the building element is used, with suitable insulating material, whereby a central insulating layer 8" is formed in the building element. Since the separating layers 22 accurately define the boundary surfaces of the central insulating layer 8", for the construction of the insulating layer it is possible to use materials which do not need to be dimensionally stable or self-supporting. The materials should, however, be heapable, pourable or flowable and may for example consist of plastics materials which can be foamed in situ, plastics waste, rubber waste, wood waste, foam plastics chips, sand, slag, expanded concrete, rice or straw waste, or stone chips. In addition, a plaster base grid 21 may be arranged on each of those surfaces of the separating layers 22 which face the wire grid mats 1 and 2 respectively.

It is understood that the exemplary embodiments described can be variously modified within the scope of the general principle of the invention; in particular it is possible for the outer shell 13 and/or the inner shell 14 or the lining board 16 to the attached to the building element already at the factory. The insulating body 8, 8' and the central insulating layer 8", as well as the separating layers 22 may be made of flame-retardant or non-flammable materials or may be impregnated or provided with substances which make the insulating body 8, 8', the central insulating layer 8" and the separating layers 22 flame-retardant or non-flammable. The insulating body 8, 8' and the separating layers 21 may in addition be provided with a flame-retardant or non-flammable coat of paint.

Within the scope of the invention it is furthermore possible for the insulating body 8, 8' or the central insulating layer 8" to project laterally beyond at least one wire grid mat 1, 2 at at least one side face 11 of the insulating body 8, 8' or of the central insulating layer 8".

What is claimed is:

1. A building component comprising:

two parallel welded wire grid mats (1, 2) formed of grid wires (3, 3', 3", 4, 4', 4", 5, 5', 5", 6, 6', 6") with square or rectangular meshes;

individual straight web wires (7, 7') holding said wire grid mats apart at predetermined distances, said web wires extending obliquely, with respect to the wire grid mats, inclined alternately in opposite directions in a trellis-work manner in each row of web wires, said individual web wires being joined at each end to said wire grid mats and being arranged in rows interspersed among the grid wires of the wire grid mats;

a one-piece insulating prefabricated block or panel forming a dimensionally stable insulating body (8) positioned between said wire grid mats and spanning more than two of said rows of web wires;

said insulating block or panel being located at predetermined distances from the wire grid mats and held between, and spaced from, the wire grid mats solely by the web wires, which web wires pierce said insulating body;

wherein said insulating body (8, 8') has a thickness of between 20 and 200 mm; and wherein at least one cover surface (18) of the insulating body (8, 8') is formed with a plurality of transverse grooves (20) positioned to extend horizontally when the building component is erected as part of a building.

2. A building component comprising:

two parallel welded wire grid mats (1, 2) formed of grid wires (3, 3', 3", 4, 4', 4", 5, 5', 5", 6, 6', 6") with square or rectangular meshes;

individual straight web wires (7, 7') holding said wire grid mats apart at predetermined distances, said web wires extending obliquely, with respect to the wire grid mats, inclined alternately in opposite directions in a trellis-work manner in each row of web wires, said individual web wires being joined at each end to said wire grid mats and being arranged in rows interspersed among the grid wires of the wire grid mats;

a one-piece insulating prefabricated block or panel forming a dimensionally stable insulating body (8) positioned between said wire grid mats and spanning more than two of said rows of web wires;

said insulating block or panel being located at predetermined distances from the wire grid mats and held between, and spaced from, the wire grid mats solely by the web wires, which web wires pierce said insulating body;

wherein said insulating body (8, 8') has a thickness of between 20 and 200 mm; and wherein at least one cover surface (18) of the insulating body (8, 8') is formed with a plurality of depressions (19) positioned to be arrayed horizontally when the building component is erected as part of a building.

* * * * *